United States Patent [19]

Andrews

[11] 3,956,860

[45] May 18, 1976

[54] CONSTRUCTION OF CONTAINERS OR TANKS

[75] Inventor: Reginald Henry Andrews, New Milton, England

[73] Assignee: Polycyl (Engineering) Limited, England

[22] Filed: May 20, 1974

[21] Appl. No.: 471,542

[52] U.S. Cl. ..... 52/245; 52/237; 52/299

[51] Int. Cl.[2] ..... L04H 7/30

[58] Field of Search ..... 52/80, 81, 237, 245, 52/249, 299

[56] References Cited

UNITED STATES PATENTS

| | | | |
|---|---|---|---|
| 2,705,349 | 4/1955 | Shaw | 52/81 |
| 2,953,276 | 9/1960 | Dunn | 52/245 |
| 3,445,866 | 5/1969 | Shields | 52/245 |
| 3,468,083 | 9/1969 | Camoletti | 52/81 |
| 3,505,769 | 4/1970 | Miron | 52/249 |

FOREIGN PATENTS OR APPLICATIONS

| | | | |
|---|---|---|---|
| 148,842 | 10/1952 | Australia | 52/245 |
| 227,652 | 1/1925 | United Kingdom | 52/80 |
| 1,157,522 | 7/1969 | United Kingdom | 52/237 |

*Primary Examiner*—Frank L. Abbott
*Assistant Examiner*—Henry Raduazo
*Attorney, Agent, or Firm*—Larson, Taylor and Hinds

[57] ABSTRACT

Tanks and containers and apparatus for constructing same wherein said apparatus comprises a plurality of bolt-together panels each of which comprises a curved panel portion bounded by flanges. The flanges are so formed as to enable a very large number of different configurations of tanks and containers to be constructed.

2 Claims, 10 Drawing Figures

Figure 3A:
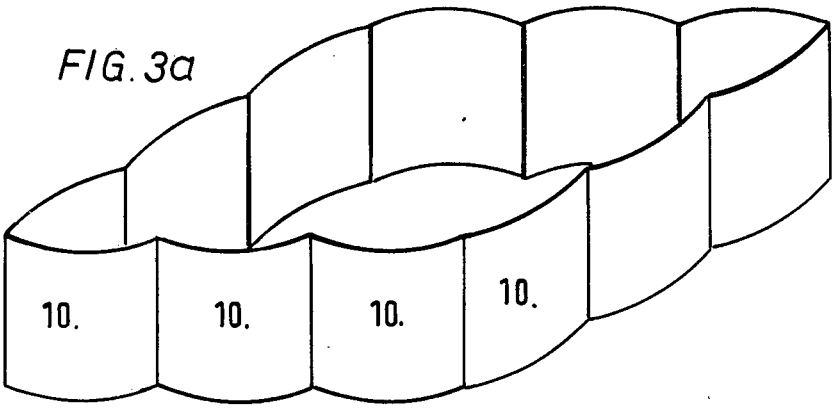
Figure 3B:
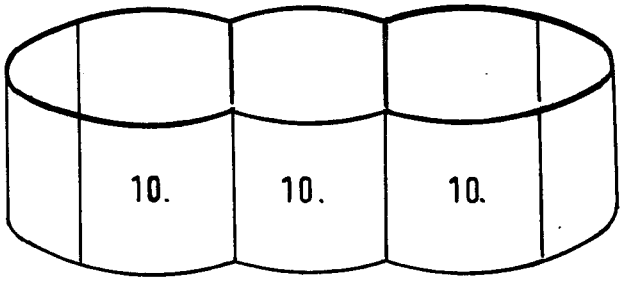
Figure 3C:
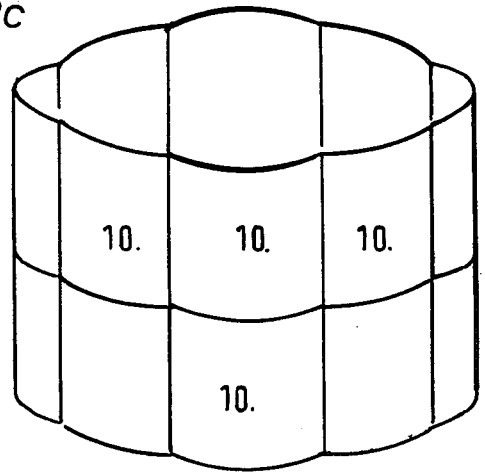

FIG. 3d
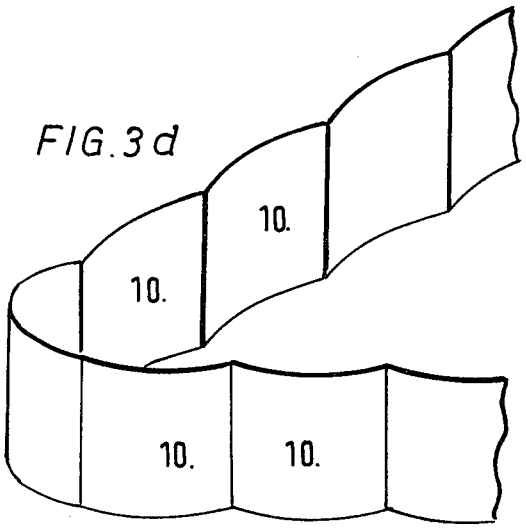
FIG. 3e
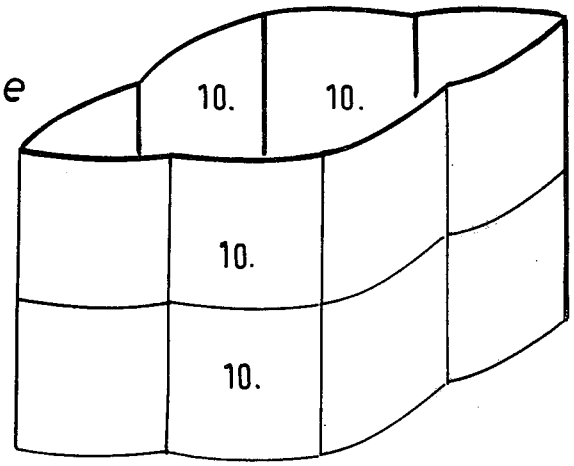
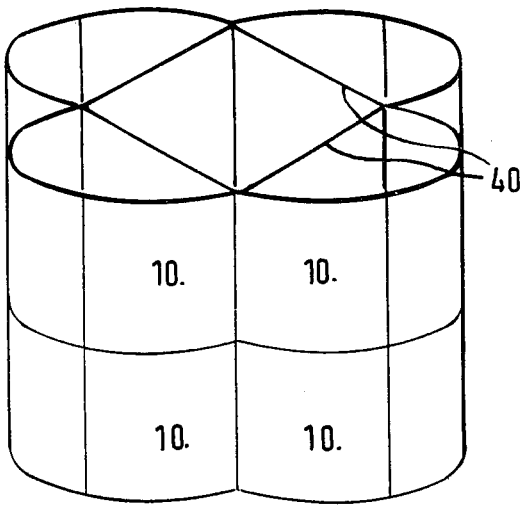
FIG. 3f

CONSTRUCTION OF CONTAINERS OR TANKS

This invention relates to tanks or containers and in particular to arrangements for making such articles.

Existing tanks or containers for holding, for example, water or corrosive fluids are generally constructed from square panels of, for example, steel or glass fibre reinforced plastics, having flanges attached to or formed along each edge whereby adjacent panels may be secured together as by riveting or bolting. The panels are substantially flat and have reinforcing ribs attached to or formed in their surfaces. In one known example of panel, made of glass fibre reinfroced plastics, the reinforcing ribs are diagonally formed. A tank constructed from such known panels requires a large number of struts or ties in order that the tank will not collapse when filled. As the struts require mounting brackets on the panels, and the work involved in adding the struts is a considerable proportion of the total time required for assembling a tank, it will be understood that such construction is very expensive. Furthermore, such tanks are limited to having a rectangular periphery and so in many cases where space is limited, it is difficult or even impossible to arrange for a tank of the required volumetric size to be constructed without making the tank unduly high and thereby further increasing the construction cost.

The present invention provides a structural member of monolithic construction and of substantially rectangular shape for constructing a tank or container and which comprises a panel portion having a cross-section of circular arc shape and flanges extending along each edge, the width of the flanges being substantially constant.

The present invention further provides a tank or container having a side wall formed from a row or a plurality of superimposed rows of structural members and of substantially rectangular shape and comprising a panel portion having a cross-section of circular arc shape and flanges along each edge, the flanges of adjacent structural members of a row being secured together to retain the members in end-to-end relationship.

Structural members according to the invention enable tanks or containers to be constructed of almost any desired peripheral shape and furthermore substantially eliminate the need for struts or ties to prevent collapse of such tanks or containers. It has further been found that the stress levels in structural members according to the invention are generally of a much lower order of magnitude than in the panels used in known forms of tanks, and the resistance to static loadings is greatly superior to known tank designs.

A further advantage to be found in tank constructions using structural members according to the invention is that deflections in the structural members as well as the overall tank structure are reduced to a low level of magnitude thus reducing sealing problems.

Each structural member may be formed in many ways, for example, from a single thickness of plastics material, from layers of different plastics materials, from a plastics material with a facing sheet of stainless steel, from coated, painted or otherwise treated steel, titanium, concrete or plywood, or even from a combination of such materials.

For convenience the structural members having panel portions in the form of part cylinders are referred to herein as "A" members.

If desired, the "A" member may be used in association with known forms of structural members having substantially flat panel surfaces with raised reinforcing portions.

In use, the structural members are conveniently bolted or riveted together with or without sealant and/or gaskets.

As thought necessary, external or internal reinforcing straps, stays, ties, columns, etc., may be provided when constructing a tank or container, and external or internal flanges may be provided on the structural members. These flanges may be of similar or of differing shapes throughout and may include double or even treble flange faces. The structural members may even be formed with a tongue and groove or a slotted flange arrangement whereby adjacent members may be joined together.

If desired, some or all of the members may incorporate ribbing, coring or any other means of stiffening or reinforcing, and loose angle, offset or other type flanges may be used for jointing where appropriate.

Figure 1B:
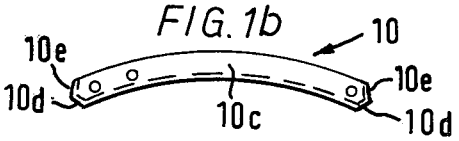
Figure 1A:
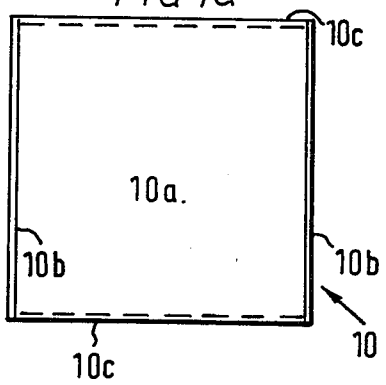
Figure 2:
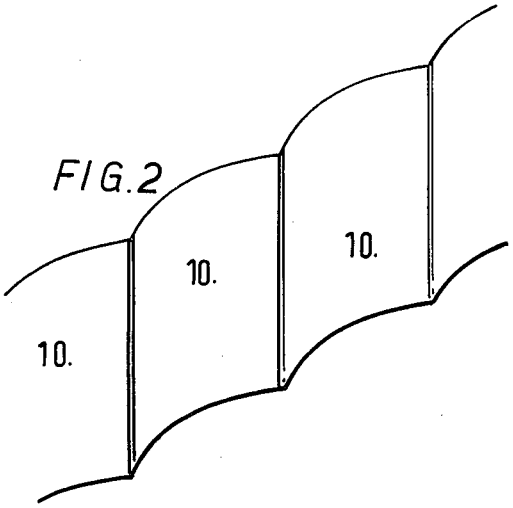
Figure 4:
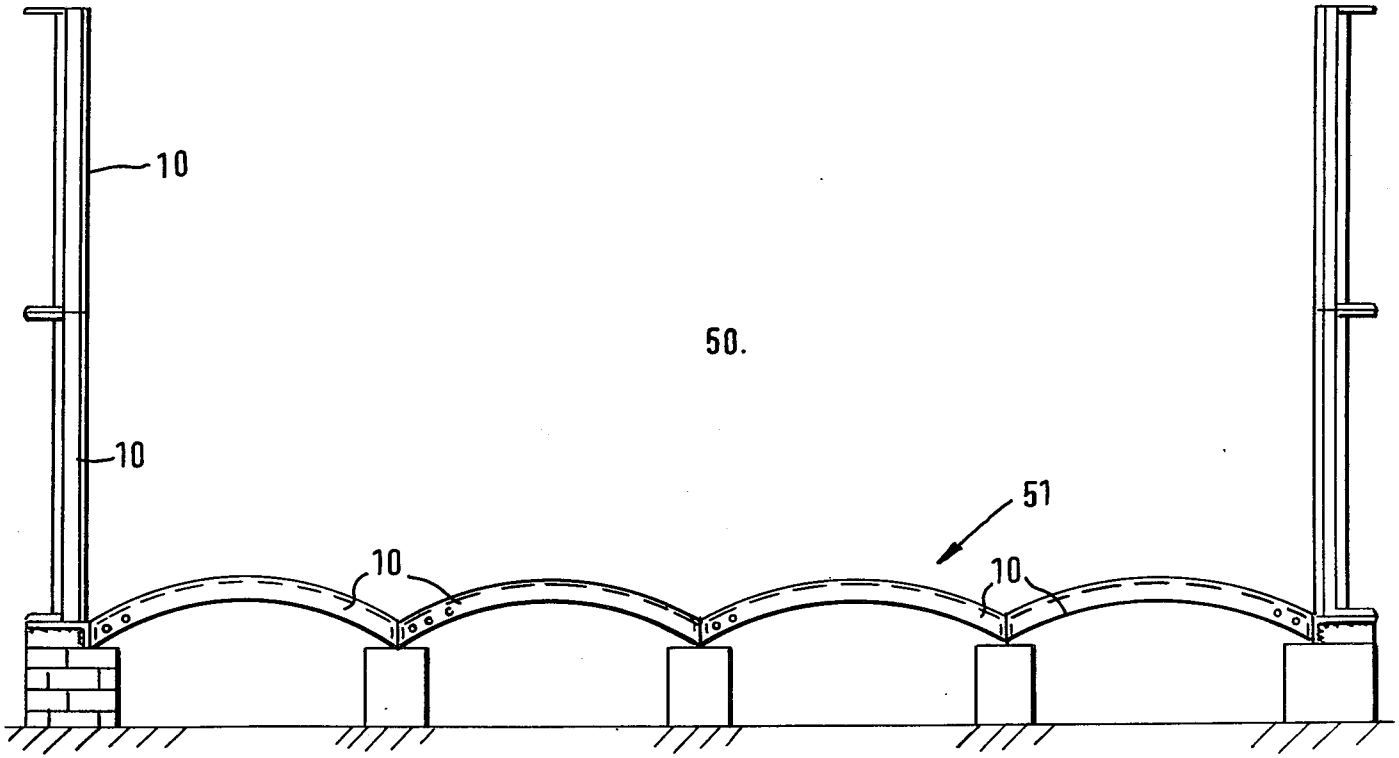

Several embodiments of the invention will now be described with reference to the accompanying drawings, in which:

FIG. 1*a* shows in elevation an "A" structural member according to the invention, FIG. 1*b* shows the member of FIG. 1*a* in top view, FIG. 2 is an isometric representation of "A" members assembled as a generally "straight" fluted wall of a tank or container according to the invention, with flanges of the members omitted for clarity, FIGS. 3*a*, 3*b*, 3*c*, 3*d*, 3*e* and 3*f* show typical arrangements of tanks according to the invention using "A" members, and FIG. 4 shows in elevation a tank according to the invention and having a bottom wall formed from "A" members.

Referring to the drawings, the "A" member 10 of FIGS. 1*a* and 1*b* comprises a panel portion 10*a* of part-cylindrical form and outwardly projecting apertured flange portions 10*b*, 10*c* extending from the edges of a panel portion and defining *a*, a rectangular shape for the member when viewed in elevation so as to enable *a*, a number of members to be secured together. A wall consisting of at least one row of members can be formed as shown in FIG. 1*f*. Each of the upper and lower flange portions 10*c* intersects the panel portion of the member 10 along a circular arc as can be seen in FIG. 1*b*, and each side flange portion 10*b* is provided with two faces 10*d*, 10*e* at an angle to each other as shown in FIG. 1*b* to enable a row of members to assume either of two different effective curvatures both of which are different from that of the panel portion 10*a*. This is clearly shown in FIGS. 3*a* and 3*c*. Joining a plurality of members 10 together by their flanges 10*d* forms a cylindrical or part cylindrical wall, whereas joining their flanges 10*e* together results in a generally "straight" but fluted wall as shown in FIG. 2.

FIGS. 3*a* to 3*f* show different forms of tanks or containers produced using "A" units. It will be noticed that in the form shown in FIG. 3*f* internal ties or stays 40 are employed to provide additional stiffening for the container.

In FIG. 4 a tank 50 is shown with its side walls and bottom 51 constructed from "A" members.

In the above described structures the members are disposed so that the convex surfaces of the panel portions face outwardly. However, it will be understood that if desired the concave surfaces of the panel portions may face outwardly.

If desired, the bottom of a tank, or part of the bottom, may be constituted by a flexible or semi-flexible membrane of, for example, synthetic rubber which may be joined to the lower edges of the side walls or to other parts of the bottom or may be extended upwards to the top edge of the container to provide a fluid tight membrane. The membrane may be fixed and/or sealed to the structural members by clamps or adhesives, with or without gaskets or jointing compounds. Bolts may be used to facilitate jointing, and the membrane may be provided with holes to receive the bolts. Loose angles, etc. may be used as desired. The use of a membrane as a bottom surface of a tank provides a simple means of construction and means that perfect flatness of the supporting ground, etc. is not required over the whole area of the bottom. Tank bottoms may, if required, be flat, of conventional panels, or of concrete, etc.

Tanks or containers made according to the invention may be horizontal as well as vertical and may be used for vehicle, rail or ship mounting, and may even be used for swimming pools.

It will be understood that stresses and deflections in the panel portions of the structural members will be lower than in an equivalent flat panel, thus enabling thinner walls to be used and reducing the cost of production. The bottom and top curved flanged joints are much stronger and more stable than straight joints, partly because of the righting couple applied by the eccentricity of the interconnecting bolts. The structural members lend themselves to production in various forms of plastics materials, for example, glass reinforced plastics, and members so produced would be inherently easier to produce than would be flat panels.

Furthermore, a sectional tank made from conventional flat panels includes a large quantity of bracing members etc., which comprise a significant proportion of the cost of a finished tank and a tank made from structural members of the type described above would require significantly less bracing members due to the inherently greater stiffness of the curved structural members.

What I claim is:

1. A container having a peripheral wall constructed from at least one row of interconnectible structural members wherein each of said structural members is of substantially rectangular shape and comprises a panel portion having a shape in cross-section of a circular arc and including a flange extending along the top, bottom and side edges thereof, the top and bottom flanges having the same circular arc shape as said panel and the side flanges each providing two planar faces at an angle to one another, one of said planar faces of each side flange, when viewed in cross-section, extending substantially perpendicular to the chord defined by the end points of the circular arc, the side flanges of adjacent structural members being interconnected in end-to-end relationship in a row to provide a said peripheral wall and at least two of said structural members being arranged in end-to-end relationship so that the said one planar face of one side flange of one structural member abuts with the said one planar face of one side flange of the other structural member so as to produce a scalloped configuration in cross-section.

2. A container according to claim 1 including a bottom wall provided by structural members which are substantially identical to the structural members forming the peripheral wall thereof.

* * * * *